US007198120B2

(12) United States Patent
Gien

(10) Patent No.: US 7,198,120 B2
(45) Date of Patent: Apr. 3, 2007

(54) DOWN-THE-HOLE DRILL ASSEMBLY

(76) Inventor: Bernard Lionel Gien, 7 Pillemar Street, Morningside, Sandton, Gauteng Province (ZA)

( * ) Notice: Subject to any disclaimer, the term of this patent is extended or adjusted under 35 U.S.C. 154(b) by 0 days.

(21) Appl. No.: 10/806,745

(22) Filed: Mar. 23, 2004

(65) Prior Publication Data

US 2004/0206550 A1 Oct. 21, 2004

(30) Foreign Application Priority Data

Mar. 25, 2003 (ZA) ..... 2003/2302

(51) Int. Cl.
*E21B 4/14* (2006.01)

(52) U.S. Cl. ..... 175/296; 175/293; 173/136

(58) Field of Classification Search ..... 175/293, 175/296; 173/204, 136
See application file for complete search history.

(56) References Cited

U.S. PATENT DOCUMENTS 3,164,214 A * 1/1965 Oelke ..... 173/73
3,692,122 A * 9/1972 Curington ..... 173/204
5,115,875 A * 5/1992 Ennis ..... 175/92
5,647,445 A * 7/1997 Puchala ..... 175/296

* cited by examiner

*Primary Examiner*—David Bagnell
*Assistant Examiner*—Giovanna M. Collins
(74) *Attorney, Agent, or Firm*—J. Harold Nissen; Lackenbach Siegel, LLP

(57) ABSTRACT

The invention provides a down-the-hole drill assembly having exhaust passages from upper and lower chambers past the inner end of a bit and through the body of the bit to exit through the bit face. The construction of the assembly and bit obviates a foot valve tube from the head of the bit and the disadvantages associated with this component.

4 Claims, 2 Drawing Sheets

1
3
2
4
5
4A
24
29
22
6
25
21
7
30
28
8
26
27
10
9
31
14
15
16
12
13
11
34
17
18
33
19
20
20
19A

DOWN-THE-HOLE DRILL ASSEMBLY

FIELD OF THE INVENTION

This invention relates to a down-the-hole drill assembly and more particularly to an assembly which eliminates the use of a foot valve tube.

BACKGROUND TO THE INVENTION

The common trend with valveless down-the-hole hammers is to have a drill bit with a replaceable foot valve tube protruding from the head of the bit at the striking face of the bit and piston. This foot valve tube extends into the bore of the piston and when the piston moves away from the bit the foot valve tube pulls out of the bore of the piston. Exhaust from the lifting or lower chamber takes place through the center of the foot valve tube to the atmosphere via the center bore of the bit.

While the piston is striking the bit, and the bore of the piston is engaged with the foot valve tube, the upper chamber is exhausting through the bore of the piston through the center of the foot valve tube and out to the atmosphere via the bore of the bit.

Exhaust from the lower and upper chamber thus takes place alternately during operation as the piston reciprocates under influence of the pressurized working fluid.

The foot valve tube is normally replaceable with one end fixed in the body of the bit and the other end is a sliding fit into the bore of the piston. The outer diameter of the foot valve tube is limited as an increase in diameter of the foot valve tube reduces the lifting surface area of the piston. It will also weaken the walls of the piston and bit at its striking face. To increase the strength of the foot valve tube the walls have to be made thicker. This will cause a further restriction in the exhausting air of the hammer and will result in reducing the performance of the hammer. Another problem experienced is the frequent breakage of the foot valve tube. This results in down time for the driller as he has to pull the drill string out the hole, remove the bit from the hammer and replace the foot valve tube.

A drill hammer assembly having an upper and lower chamber as well as a foot valve tube is disclosed in the applicant's earlier filed U.S. Pat. No. 6,543,557.

OBJECT OF THE INVENTION

It is an object of this invention to provide a down-the-hole drill assembly which avoids the use of a foot valve tube.

SUMMARY OF THE INVENTION

In accordance with this invention there is provided a down-the-hole drill assembly providing exhaust passages from upper and lower chambers past the inner end of a bit and through the body of the bit to exit through the bit face.

The invention also provides for the bit to have openings extending transversely through the wall of the bit into a blind bore extending from the bit face.

Further features of this invention provide for at least one vent extending through the bit body from the bit face to provide the outlet for the exhaust passages.

A still further feature of this invention provides for a flushing air orifice through the closed end of the bit.

Another aspect of this invention provides a drill bit for the assembly above defined.

BRIEF DESCRIPTION OF THE DRAWINGS

These and other features of this invention will become apparent from the following description of embodiments, by way of example only, with reference to the accompanying drawings in which.

DETAILED DESCRIPTION OF THE INVENTION

Figure 1:
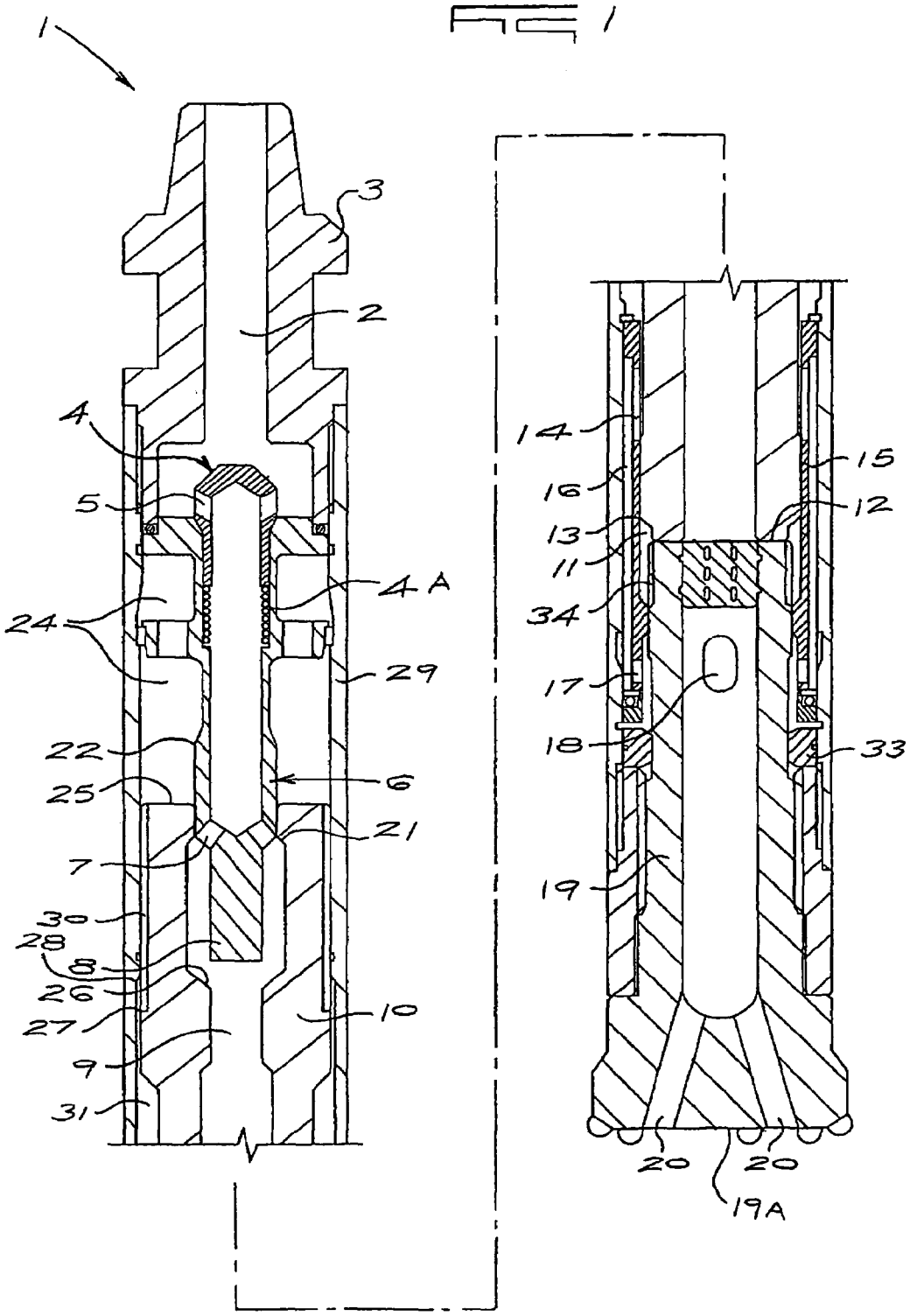
FIG. 1 is a longitudinal cross section through the drill assembly.

As illustrated a down-the-hole drill hammer embodies the drill assembly (1) in accordance with this invention. The assembly (1) provides for lifting air to the lower chamber (11) below the piston (10) via the bore (9) of the piston (10) and the exhaust via the outside of the piston (10) and also via at least part of the outside of the bit (19) body. The exhaust air is then directed via opening (18) to the inside of the bit's drill face (19A) only because it is beneficial for flushing the drill cuttings out from underneath the bit face (19A). The function of the hammer is effective due to the fact that the compressed air flows directly through the bore (9) of the piston (10) with no deviation into the lower chamber (11) and causes the piston (10) to reciprocate faster thereby releasing more energy to the bit (19).

In this embodiment of the invention, the bit (19) has openings (18) extending transversely through the wall of the bit (19) into a blind bore (19B). The bore (19B) extends from the bit face (19A) through vents (20).

Operatively described, the down-the-hole drill assembly (1) has compressed air entering the hammer via inlet (2) through the backhead (3). The flow of the compressed air opens check valve (4) down against its spring bias (4A) and the air flows through check valve ports (5) down the air distributor (6) and out of ports (7). Pin (8) is disengaged from bore (9) of piston (10). The air flows down the piston bore (9) to pressurize lower chamber (11). The pressure acts on surface area (12) to lift the piston (10) to start its upward stroke. During the upward stroke, pin (8) enters bore (9) to shut off the airflow to chamber (11).

The piston (10) continues in its upward stroke and shoulder (13) of the piston (10) passes ports (14) in the inner sleeve (15). The expanding air in lower chamber (11) exhausts through ports (14) down cutout (16) past the inner end of the bit (19) through ports (17) of the inner sleeve (15), through opening (18) into the bore (19B) of the bit (19) and through vents (20) to the atmosphere.

The piston (10) continues traveling upward with piston bore (9) shut off by pin (8). Shoulder (21) of the piston (10) passes shoulder (22) of the air distributor (6) and air flows from ports (7) via the bore (9) of the piston (10) into upper chamber (24). The pressure in chamber (24) now acts on surface area (25) and (26) to cause the piston (10) to travel downward towards the bit (19). During the piston's downward travel, step (27) on the piston (10) passes cutout (28) in wear sleeve (29). The expanding air from chamber (24) exhausts down cutouts (30) on the piston (10) down through passage (31) through ports (14) in the inner sleeve (15) down cutout (16) through ports (17) then opening (18) into bore (19B) of the bit (19) and through vents (20) to the atmosphere.

An exhaust passage from the lower chamber (11) is thus provided through ports (14), cutout (16), ports (17), opening (18), bore (19B) and vents (20). The upper chamber (24) is connected to the lower chamber (11) exhaust passage through cutouts (30), cutout (28) and passage (31) thereby providing its exhaust passage.

Both of these exhaust passages extend past the inner end of the bit (19) and through the body of the bit (19) to exit through the bit face (19A).

When the bit (19) is lifted away from the rock face, the bit (19) will drop forward to be stopped by the bit retaining rings (33). The piston (10) will follow the bit (19) and ports (7) will be exposed to upper chamber (24) and lower chamber (11). Air pressure acting on surfaces (25) and (26) exerts more force than the pressure acting on surface area (12) in lower chamber (11). The piston (10) will therefore remain inoperative. The airflow from upper chamber (24) follows the exhaust path down (30), (31) through port (14) down (16) and through (17), (18), (19B) and (20) to the atmosphere. Pressure in lower chamber (11) is released via cutouts (34) on the bit (19) head, through (18), (19B) and (20) to the atmosphere.

The assembly (1) is robust and provides satisfactory operating surfaces on the piston (10) and bit (19) both for air pressure and striking force.

Figure 2:
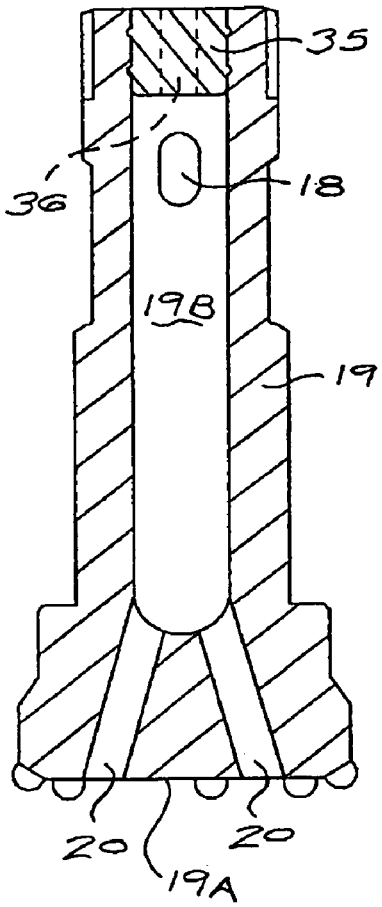
FIG. 2 shows the bit of the assembly in FIG. 1.

FIG. 2 shows the bit (19) of the above described drill assembly (1). The bore (19B) is formed by drilling from the inner end of the bit (19) and subsequently fitting a plug (35) to close the opening at the inner end of the bit (19). The lateral opening (18) is elongate to provide easy flow of exhaust air from the assembly to flush the outer operative end at the face (19A) of the bit (19).

The plug (35) can also be provided with an additional flushing air orifice (36) and may be made to be interchangeable with a solid plug. Such an orifice (36) is desirable under certain drilling conditions where additional flushing is required. The orifice will normally have a diameter of about 3 mm and will generally not exceed a diameter of about 10 mm. While the performance of the hammer will be adversely effected, the benefit of using of such a plug (35) in said conditions with an air compressor of suitable capacity will be appreciated by a person suitably skilled in the art.

Figure 3:
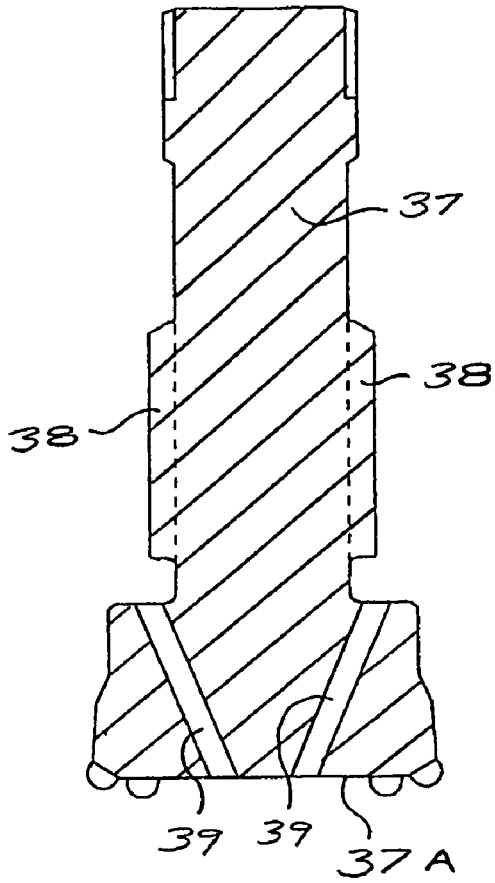
FIG. 3 show an alternative form of drill bit.

FIG. 3 shows an alternative drill bit (37) which has no axial exhaust passage in the form of a bore but where such passage is provided at (38) in the outer part of the bit (37). These passages (38) feed into vents (39) which extend through the body of the bit (37) to exit through the bit face (37A) to the atmosphere.

It will be appreciated that the exhaust air flow passages of the drill assembly can take several different configurations. All of these will permit the foot valve tube to be dispensed with providing concomitant advantages to the assembly.

The invention claimed is:

1. A down-the-hole drill assembly having a reciprocating piston with a bore extending therethrough, a length of the bore being inwardly stepped to snugly receive a closed end pressurized air distributor tube having an apertured sidewall, an upper chamber for pressurized air to cause downward travel of the piston, a lower chamber for pressurized air to cause the piston to lift and a drill bit with an inner end, body and face, the inner end of the bit being closed and exhaust passages being provided from the upper and lower chambers past the inner end of the bit and through the body of the bit to exit through the bit face, wherein the piston is movable between a driving position in which the bore step is open and the distributor aperture is in flow communication with the piston bore, and a lifted position in which the bore step is closed by the distributor and the aperture is in flow communication with the upper chamber.

2. A drill assembly as claimed in claim 1 wherein the exhaust passages exit via at least one vent extending through the bit body from the bit face.

3. A drill assembly as claimed in claim 1 wherein the bit has openings extending transversely through the body of the bit into a blind bore extending from the bit face.

4. A drill assembly as claimed in claim 3 wherein a flushing air orifice extends through the closed inner end of the bit.

* * * * *